US012742544B2

(12) United States Patent
Yoh

(10) Patent No.: US 12,742,544 B2
(45) Date of Patent: Sep. 22, 2026

(54) SMART CANDLE WITH AUTOMATIC EXTINGUISHING FUNCTION

(71) Applicant: Brent Yoh, Syracuse, UT (US)

(72) Inventor: Brent Yoh, Syracuse, UT (US)

( * ) Notice: Subject to any disclaimer, the term of this patent is extended or adjusted under 35 U.S.C. 154(b) by 345 days.

(21) Appl. No.: 18/665,104

(22) Filed: May 15, 2024

(65) Prior Publication Data

US 2025/0354686 A1 Nov. 20, 2025

(51) Int. Cl.
*F23D 3/16* (2006.01)
*F23D 3/26* (2006.01)

(52) U.S. Cl.
CPC *F23D 3/16* (2013.01); *F23D 3/26* (2013.01)

(58) Field of Classification Search
CPC ..... F23D 3/16; F23D 3/26
USPC ..... 431/289
See application file for complete search history.

(56) References Cited

U.S. PATENT DOCUMENTS 5,264,995 A * 11/1993 McKee ..... F21S 13/00 362/161
6,270,339 B1 * 8/2001 Zou ..... F23D 3/30 362/228
7,841,857 B2 * 11/2010 Viggiani ..... F23D 3/26 431/290
2003/0104331 A1 * 6/2003 Kuelbs ..... F23D 3/28 431/315
2023/0313991 A1 * 10/2023 Riga ..... F23D 3/30 431/33

* cited by examiner

*Primary Examiner* — Avinash A Savani
(74) *Attorney, Agent, or Firm* — Steven Rinehart

(57) ABSTRACT

A smart candle operable to feed a wick automatically to a shank, the smart candle comprising an electromechanical mechanism, a heat sensor, a motor and a reservoir in some embodiments. The smart candle may be set to burn for a predetermined period of time.

6 Claims, 4 Drawing Sheets

SMART CANDLE WITH AUTOMATIC EXTINGUISHING FUNCTION

FIELD OF THE INVENTION

This invention relates to lighting and candles and more particularly relates to an intelligent candle operable to have a natural flame and adjustable brightness.

BACKGROUND

Description of the Related Art

Lighting devices for interior spaces have slowly evolved over centuries, from torches to candles to oil-burning lamps, and finally to incandescent bulbs and LEDs. With each evolution, lights become cleaner and more efficient, but have become reliant on electricity for power. With recent evolutions in lighting comes a desire of some to return to traditional flames for lighting purposes, which can provide a sense of nostalgia or legacy when celebrating older traditions or during holidays. Others prefer lighting from natural flames to eliminate reliance on electricity.

For those who wish to return to traditional candle lighting, there are not safety functions incorporated into them. Traditional candles present a fire danger. Hot wax can destroy candle sticks and surfaces upon which a candle is placed and burn others. Traditional candles quickly rely on fuel and exhaust organic material and pollutants into ambient interior spaces.

There is an unmet need in the art for a candle with a traditional natural flame which overcomes these inefficiencies in the art, which does not melt candle wax, present fire unnecessary fire hazards, burn excessive fuel, and which has an adjustable everlasting flame.

A smart candle which overcomes these difficulties inherent in the art is therefore desirable.

SUMMARY

From the foregoing discussion, it should be apparent that a need exists for a smart candle with automatic extinguishing function. Accordingly, the present invention has been developed to provide a smart candle, the smart candle comprising: a cylindrical body having an open top end defining a hollow interior cavity; a coil of wick housed within the hollow interior cavity; a weight base detachably affixed to a lower edge of the cylindrical body, the lower base defining an annular recess operable to receive and partially circumscribe the cylindrical body; an end cap detachably affixable to the open top end of the cylindrical body, the end cap comprises a shank, the shank comprising a plurality of protuberances arrange concentrically around an aperture through which a wick is fed; an electromechanical mechanism housed within the hollow interior recess, the electromechanical mechanism comprising a heat sensor, a motor, a feeding tube, and operable to feed the wick to the electromechanical mechanism in response to heat falling below a predetermined threshold; and a reservoir comprising a combustible fluid.

The combustible fuel may comprise one of naphtha, butane and kerosine. The wick may be housed within the reservoir. The feeding tube may be housed within the reservoir. The electromechanical mechanism may further comprise a knob operable to set the predetermined time.

The electromechanical mechanism may further comprise a snuffer operable to extinguish the flame.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

It is an object of the present invention to provide a smart candle with dimming adjustment function and everlasting natural flame.

Figure 1:
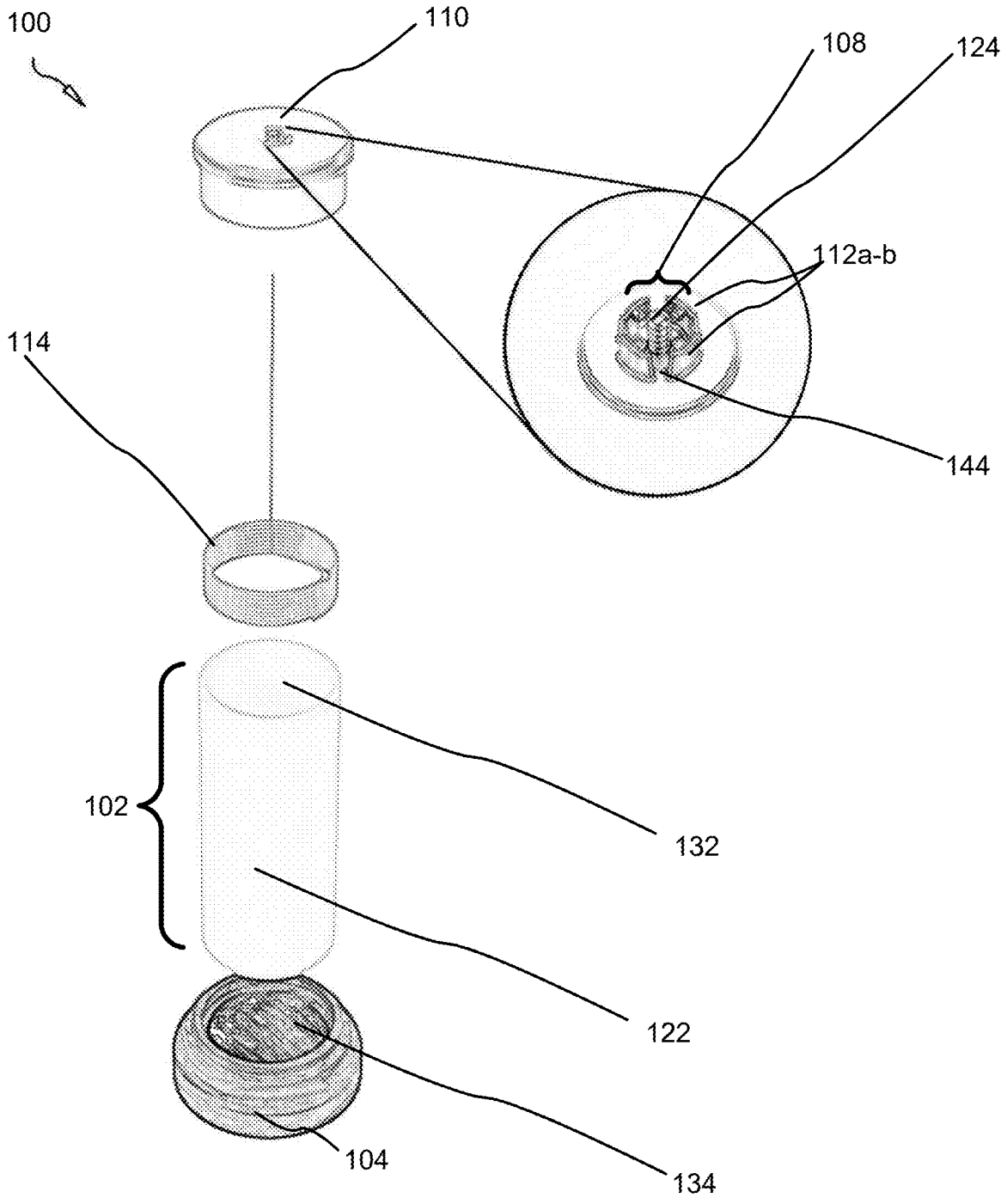
FIG. 1 is an exploded isometric perspective view illustrating one embodiment of a smart candle with dimming function in accordance with the present invention.
Figure 2:
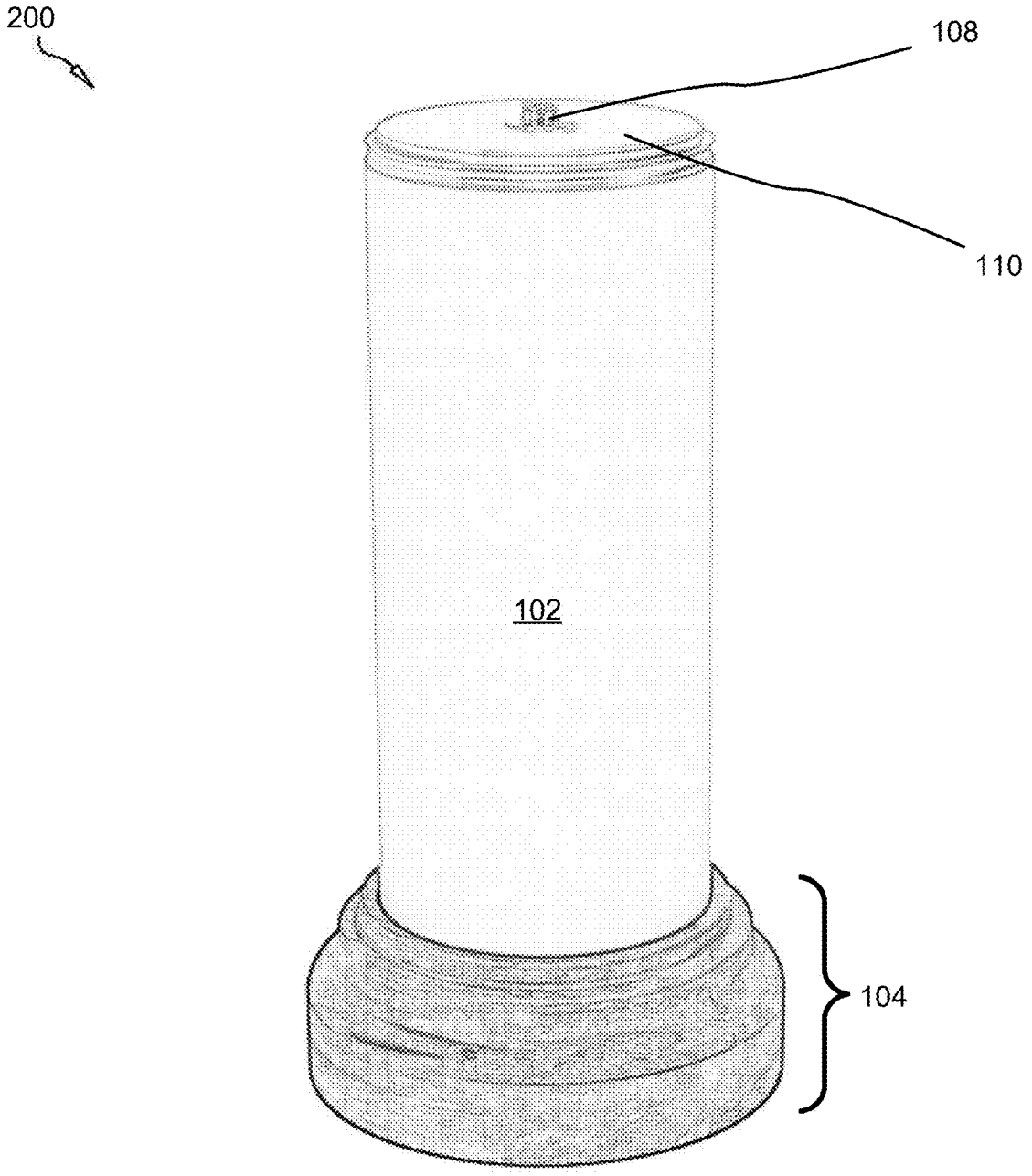
FIG. 2 is an exploded isometric perspective view illustrating one embodiment of a smart candle in accordance with the present invention.

FIGS. 1-2 illustrate perspective views of embodiments of a smart candle 100 with dimming function in accordance with the present invention.

The candle 100 comprises a cylindrical body 102 having a hollow interior cavity 132. The cylindrical body 102 may be fabricated from, or comprise, polymeric materials or alternatively may be fabricated from metal or metal alloy materials. In various embodiments, a coil of wick 114 is housed within the hollow interior cavity. This coil 114 may be slowly extruded through a feeding tube 310 and nozzle 108.

The body 102 comprises an open top end detachable affixed to an end cap 110. The end cap 110 comprises a shank 108 (i.e., nozzle 108) having a plurality of protuberances 112. In the shown embodiment, the shank 108 consists of four protuberances 112 but may comprise two, three or more. A gap, or recess, is defined between protuberances 112*a-b* useful for oxygenating a flame dancing, or lit, on or above the shank 108. These protuberances 112 may circumscribe the shank axially.

The shank 108, or nozzle 108, defines a centric aperture traversing the end cap 110. The wick 124 traverses this aperture and is fed into the shank 108 by electromechanical means, such as an electric motor.

The candle 100 also comprises a base 104, or baseplate 104, or stand 104, which is weighted to secure the cylindrical body 102 in place on a table or other surface. In various embodiments, the base 104 defines an annular cavity 134 adapted to receive a lower edge of the cylindrical body 102.

Figure 3:
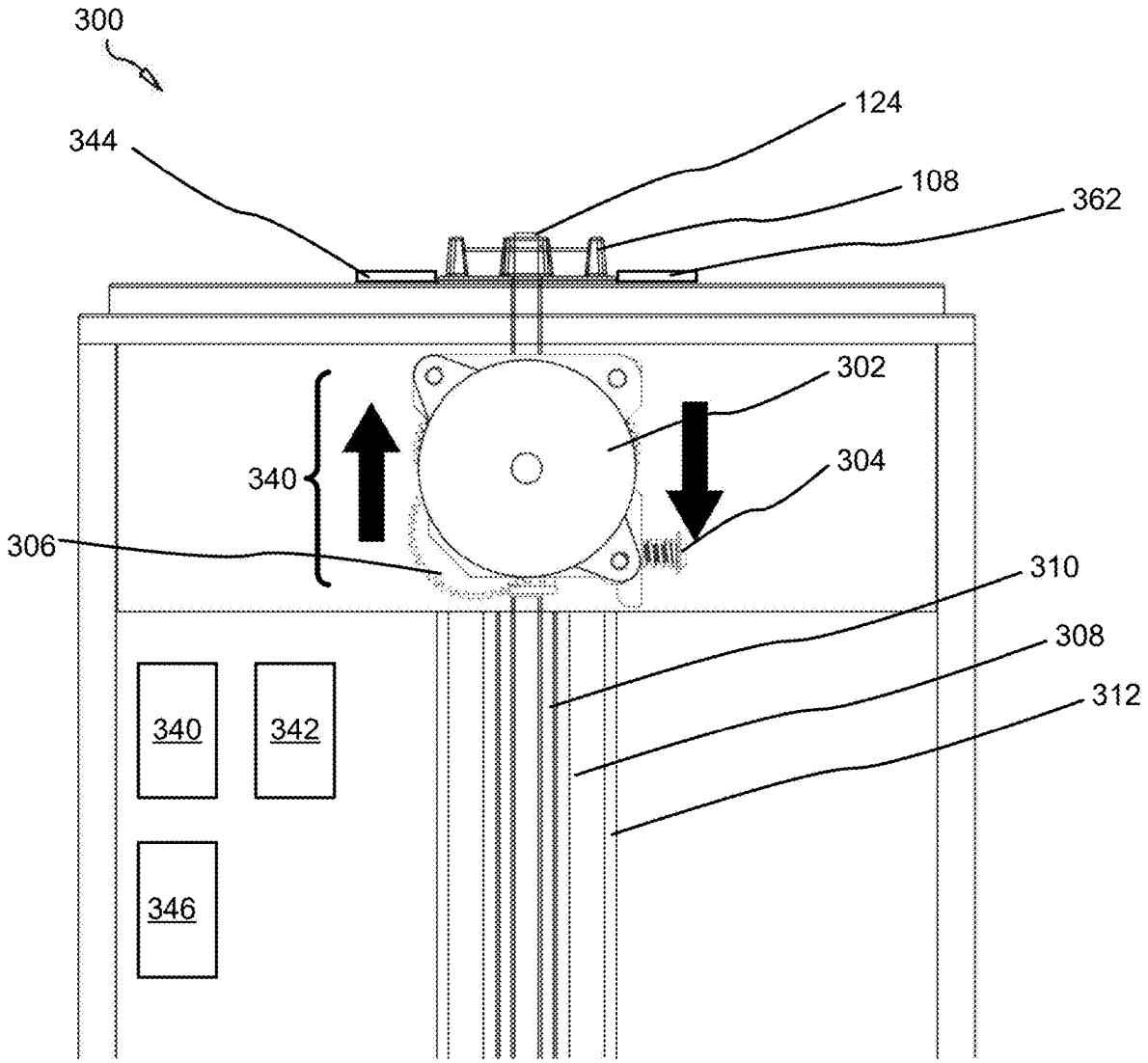
FIG. 3 is a sectioned side perspective view illustrating one embodiment of a smart candle in accordance with the present invention.

FIG. 3 is a sectioned side perspective view illustrating one embodiment of a smart candle 300 in accordance with the present invention.

In various embodiments, the candle 300 comprises electromechanical mechanism 340 operable to feed the wick 124 into the shank 108 through a feeding tube 310. The feeding tube 310 may be surrounded by a reservoir 312 having a combustible material 308 such as naphtha, butane, kerosine, or the like. The wick 124 is drenched in the combustible material 312 as it travels through the feeding tube 308.

In various embodiments, the apparatus 300 comprises an autoignition 344, which may be: (1) activated by a user either manually or by causing an electronic signal to be relayed to the apparatus 300 from a DPD in logical connection with the apparatus 300; and (2) electronically activated with a signal originating with a software process internal to the apparatus 300 or a remote DPD in logical connectivity with the ASIC 346 of the apparatus 300, which ASIC may send an ignition signal to the autoignition 344. This signal may comprise a Boolean and/or simply a temporary voltage, amperage, and watt surge.

In alternative embodiments, the coil 114 is housed with the reservoir 312 and drenched with the combustible material 308. In still further embodiments, the wick 124 itself is infused with a flammable or combustible material.

The electromechanical mechanism 340 may comprise a heat sensor, a plurality of gears 306, a knob 302, a spring-loaded screw operable to be permit manual adjusted of a tensile force, and snuffer operable to extinguish the flame by applying tensile force to the wick 124. The snuffer may apply a clamping force and clamps to the exposed wick above a base floor 144 of the shank.

In still further embodiments, the electromechanical mechanism 340 is operable to retract the wick 124 after expiration a predetermined amount of time set with the knob 302 (i.e., dial 302).

The electromechanical mechanism 340 may be operable to extrude the wick to a predetermined height above the shank thus controlling the height of the flame, the heat of the shank, and increasing fuel burn. The height of the wick may be adjustable to 0.1 mm to 10 mm.

The apparatus 300 may comprise a thermometer 362 operable to measure a temperature at, or near, the shank. The apparatus 300 may be configured to correlate heat at the shank with wick height.

In various embodiments, the electromechanical mechanism 340 is adapted and operable to feed the wick 124 into the shank 108 in response to sensed temperature by a heat sensor falling. This drop in temperature may be indicative a wick losing fuel and the need to feed wick into the shank 108 to maintain the flame.

The snuffer may apply partial pressure to the wick 124 to dim the wick and flame in some embodiments using one or more electronically activated clamps in electrical or logical connection with a chip such as an ASIC (application specific integrated circuit) 346.

The reservoir 312 may be positioned anywhere within the hollow cylindrical cavity 132, and may comprise enough to fuel to keep the candle 300 burning near continuously, meaning for multiple days or weeks.

In some embodiments, the apparatus 300 may comprise a computer program running on one or more data processing devices (DPDs) internal to the apparatus 300. In various embodiments, the DPD comprises one or more processors. The processor is a computing device well-known to those in the art and may include an application-specific integrated circuit ("ASIC") 346.

The apparatus 300 may be in wireless connectivity with a remote DPD such as a server, computer workstation, router, mainframe computer, cellular smart phone, or the like.

The remote DPD, or server, comprises the front end logic necessary to receive and transmit bitstreams (i.e., datastreams). The server may include the software, firmware, and hardware necessary to receive and process textualized content, including buffers, data unloaders, video unloaders, and the like.

In various embodiments, wireless input is received by the apparatus 300 via the receiver 342 using protocols and means known to those of skill in the art, including BluetTooth®. This wireless input 342 may be sent from the remote data processing device (DPD) such as a tablet computer, smart phone, server, personal computer, and the like. In various embodiments, the remote DPD is in wireless connectivity with the apparatus 300 via a local area network (LAN) or wide area network (WAN).

The apparatus 300 may comprise means for relaying and receiving electrical signals enabling device-to-device communication (meaning wireless transmission of instructions, including instructions to ignite, extinguish, run for a certain period of time, and at what flame setting). The apparatus 300 may be configured to make use of the Bluetooth® protocols and procedures enabling device-to-device intercommunication connectivity. This functionality may be provided by incorporating the Bluetooth Intercom Profile® and/or the Bluetooth Telephony Profile®, or other wireless technologies known to those of skill in the art.

This communication may be in accordance with core specifications of one or more subsets of Bluetooth® profiles, wherein the core specifications comprise one or more of: the Cordless Telephony Profile (CTP), the Device ID Profile (DIP), the Dial-up Networking Profile (DUN), the File Transfer Profile (FTP), the Hands-Free Profile (HFP), the Human Interface Device Profile (HID), the Headset Profile (HSP), and the Intercom Profile (ICP), the Proximity Profile (PXP).

Figure 4A:
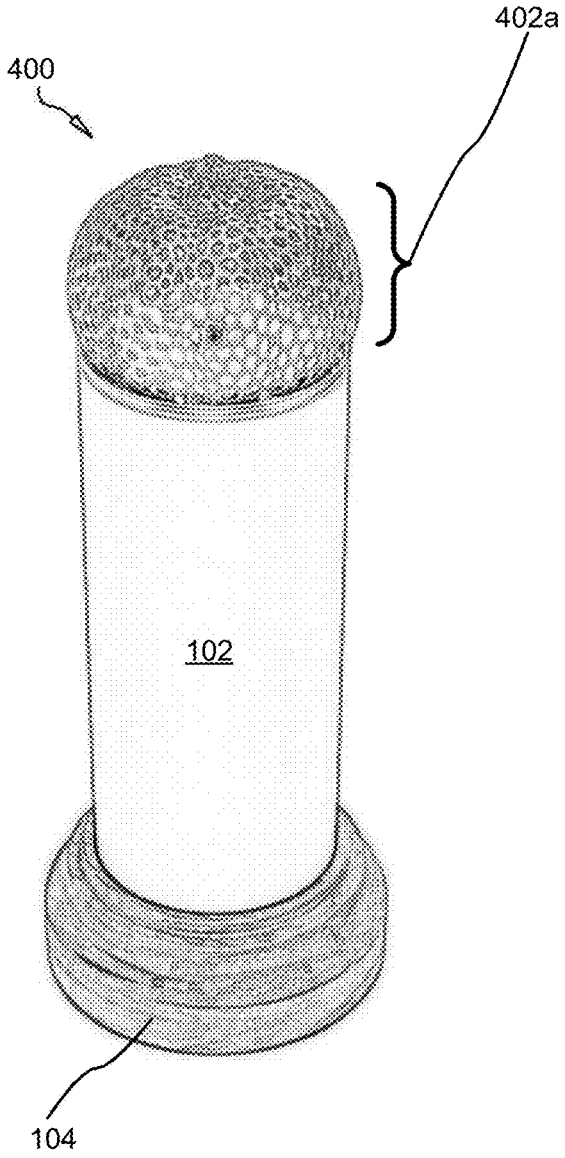
FIG. 4A is a side perspective view illustrating one embodiment of a smart candle in accordance with the present invention.
Figure 4B:
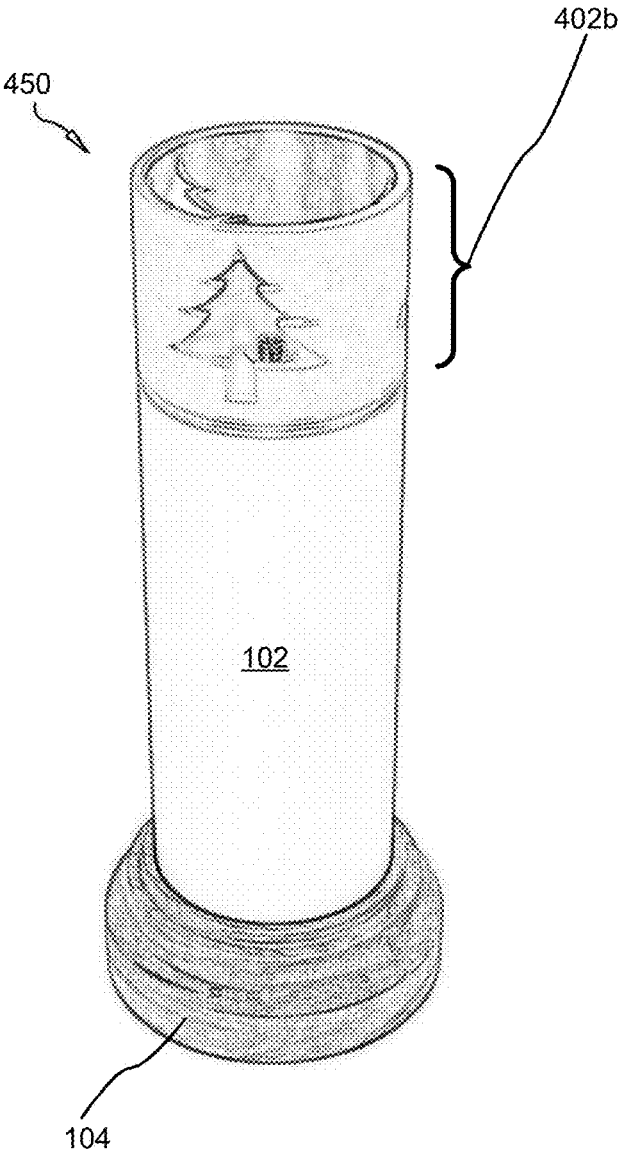
FIG. 4B is a side perspective view illustrating one embodiment of a smart candle in accordance with the present invention.

FIGS. 4A-4B illustrate side perspective views of embodiments of a smart candle 400 in accordance with the present invention.

In various embodiments, the candle 400 would comprise a topper or shroud 402*a* which may be ornamental or decorative, such as the pumpkin-shaped topper 402*a* or a Christmas topper 402*b*.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A smart candle, the smart candle comprising:

a cylindrical body having an open top end defining a hollow interior cavity;

a coil of wick housed within the hollow interior cavity;

a weight base detachably affixed to a lower edge of the cylindrical body, the lower base defining an annular recess operable to receive and partially circumscribe the cylindrical body;

an end cap detachably affixable to the open top end of the cylindrical body, the end cap comprises a shank, the shank comprising a plurality of protuberances arrange concentrically around an aperture through which a wick is fed;

an electromechanical mechanism housed within the hollow interior recess, the electromechanical mechanism comprising a heat sensor, a motor, a feeding tube, and operable to feed the wick to the electromechanical mechanism in response to heat falling below a predetermined threshold; and a reservoir comprising a combustible fluid.

2. The smart candle of claim 1, wherein the combustible fuel comprises one of naphtha, butane and kerosine.

3. The smart candle of claim 1, wherein the wick is housed within the reservoir.

4. The smart candle of claim 1, wherein the feeding tube is housed within the reservoir.

5. The smart candle of claim 1, wherein the electromechanical mechanism further comprises a knob operable to set the predetermined time.

6. The smart candle of claim 1, wherein the electromechanical mechanism further comprises a snuffer operable to extinguish the flame.

* * * * *